US008276781B1

(12) United States Patent
Smith

(10) Patent No.: US 8,276,781 B1
(45) Date of Patent: Oct. 2, 2012

(54) DRINKING CONTAINER ASSEMBLY

(76) Inventor: Bryon M. Smith, Corona, CA (US)

( * ) Notice: Subject to any disclaimer, the term of this patent is extended or adjusted under 35 U.S.C. 154(b) by 423 days.

(21) Appl. No.: 12/561,422

(22) Filed: Sep. 17, 2009

(51) Int. Cl.
*B65D 41/00* (2006.01)
*B65D 43/00* (2006.01)

(52) U.S. Cl. ..... 220/707; 220/703; 220/705; 220/709; 220/710; 215/229; 215/387; 215/388; 215/389

(58) Field of Classification Search ..... 220/229, 220/703, 705, 707, 709, 710, 826; 215/229, 215/387, 388, 389
See application file for complete search history.

(56) References Cited

U.S. PATENT DOCUMENTS 3,486,679 A 12/1969 Pfahler
4,043,478 A 8/1977 Duncan
4,462,503 A * 7/1984 Di Raffaele et al. ..... 220/707
4,573,631 A 3/1986 Reeves
4,923,084 A * 5/1990 Forbes ..... 220/705
5,078,286 A 1/1992 Hashimoto
5,385,264 A 1/1995 Kaufman et al.
5,676,306 A * 10/1997 Lankin et al. ..... 229/404
D469,691 S 2/2003 Brondyke et al.
6,648,217 B2 11/2003 Schein
7,392,916 B1 * 7/2008 Kuighadush ..... 220/707
2005/0061822 A1 * 3/2005 Naesje ..... 220/705
2005/0139603 A1 * 6/2005 Lee ..... 220/705
* cited by examiner

*Primary Examiner* — Anthony Stashick
*Assistant Examiner* — Madison L Wright

(57) ABSTRACT

A drinking container assembly includes a housing that has a bottom wall and a perimeter wall which is attached to and extends upwardly from the bottom wall. The perimeter wall has an upper edge defining an opening extending into the housing. A closure is attached to and is coextensive with the upper edge. The closure is positionable in an open position extending upwardly from the upper edge or in a closed position folded downwardly over the opening. The closure has an access aperture extends their through and into the housing when the closure is in the closed position.

1 Claim, 7 Drawing Sheets

DRINKING CONTAINER ASSEMBLY

BACKGROUND OF THE DISCLOSURE

Field of the Disclosure

The disclosure relates to drinking container devices and more particularly pertains to a new drinking container device for holding beverages and for drinking beverages therefrom.

SUMMARY OF THE DISCLOSURE

An embodiment of the disclosure meets the needs presented above by generally comprising a housing that has a bottom wall and a perimeter wall which is attached to and extends upwardly from the bottom wall. The perimeter wall has an upper edge defining an opening extending into the housing. A closure is attached to and is coextensive with the upper edge. The closure is positionable in an open position extending upwardly from the upper edge or in a closed position folded downwardly over the opening. The closure has an access aperture extends their through and into the housing when the closure is in the closed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
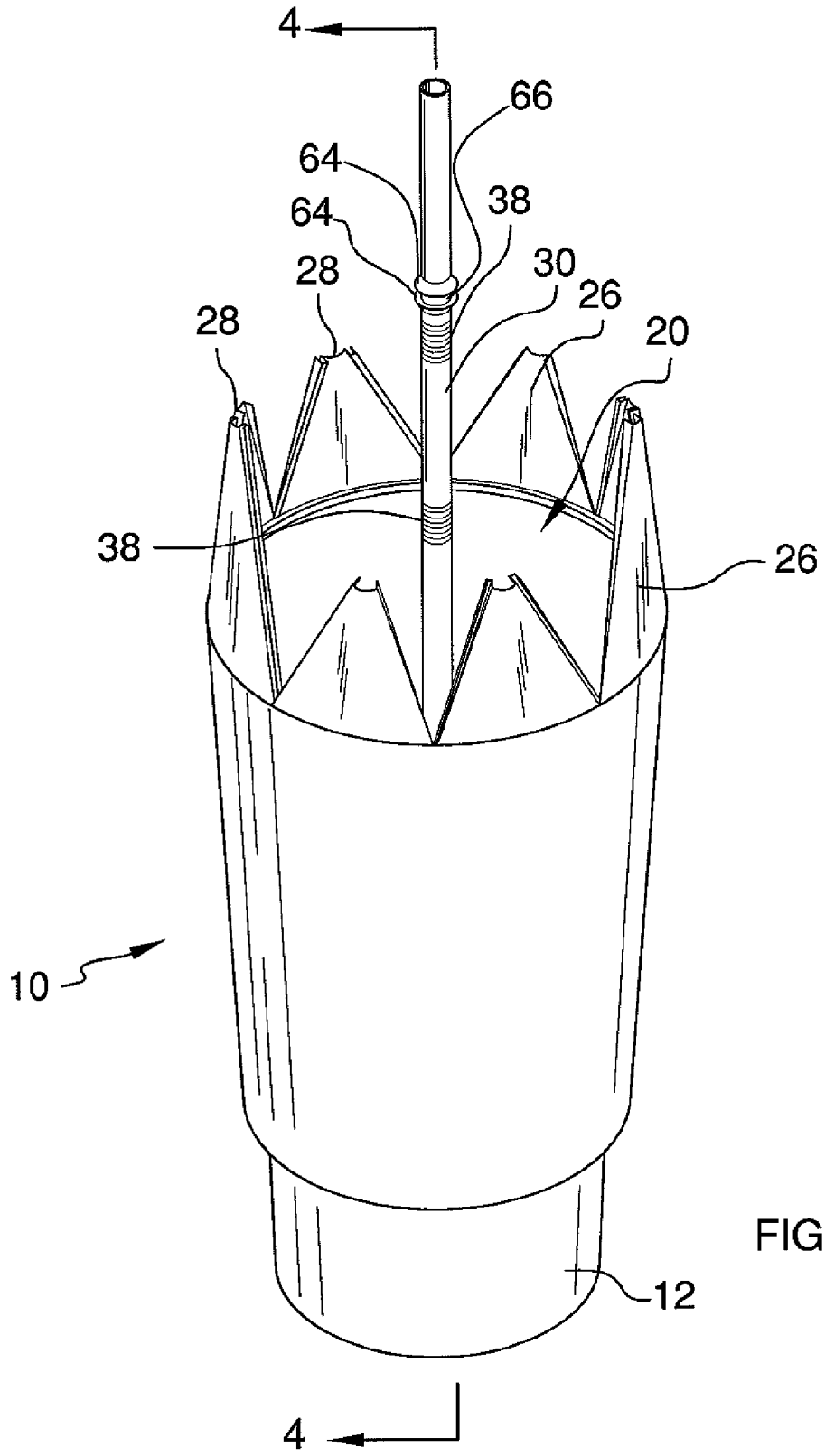
FIG. 1 is a front perspective view of a drinking container assembly according to an embodiment of the disclosure.
Figure 2:
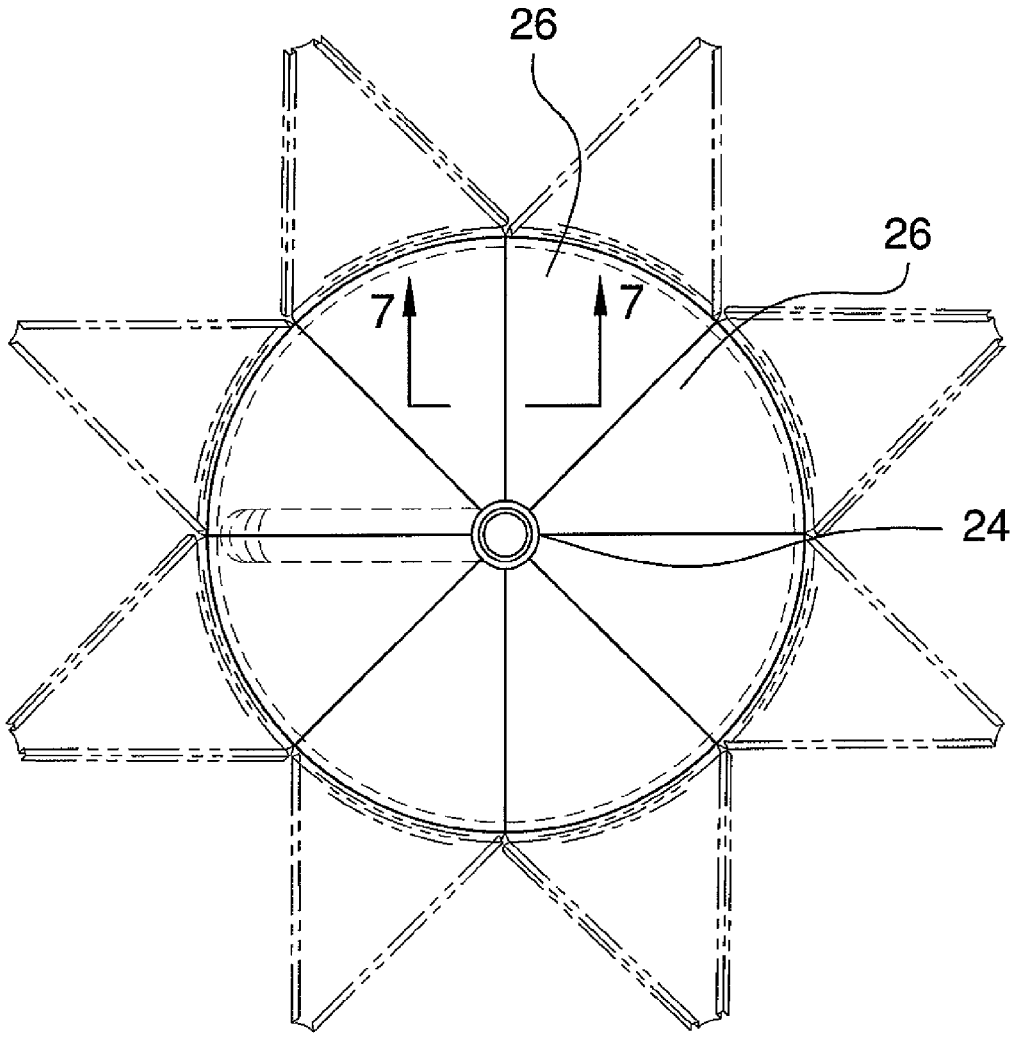
FIG. 2 is a top view of an embodiment of the disclosure.
Figure 3:
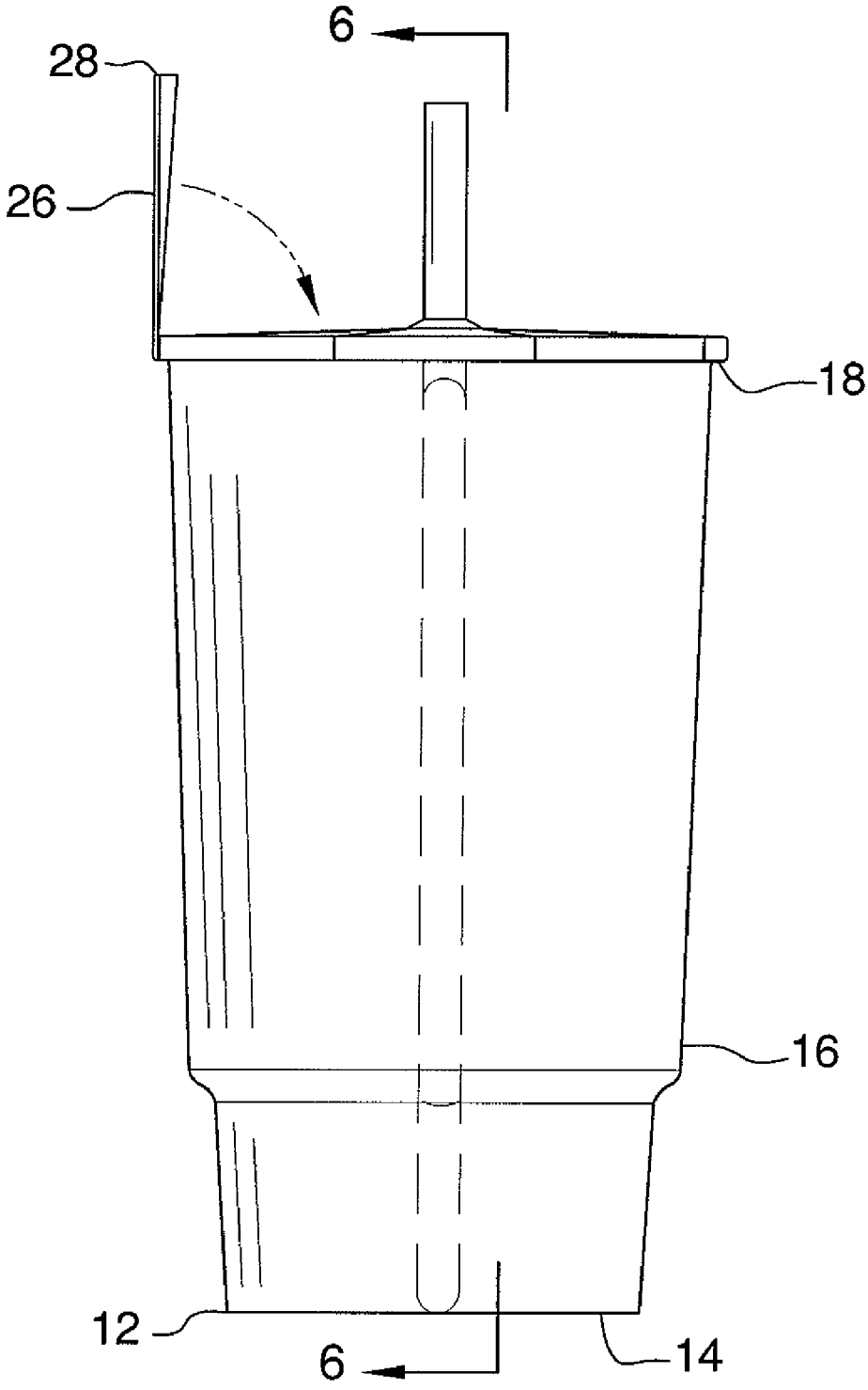
FIG. 3 is a rear view of an embodiment of the disclosure.
Figure 4:
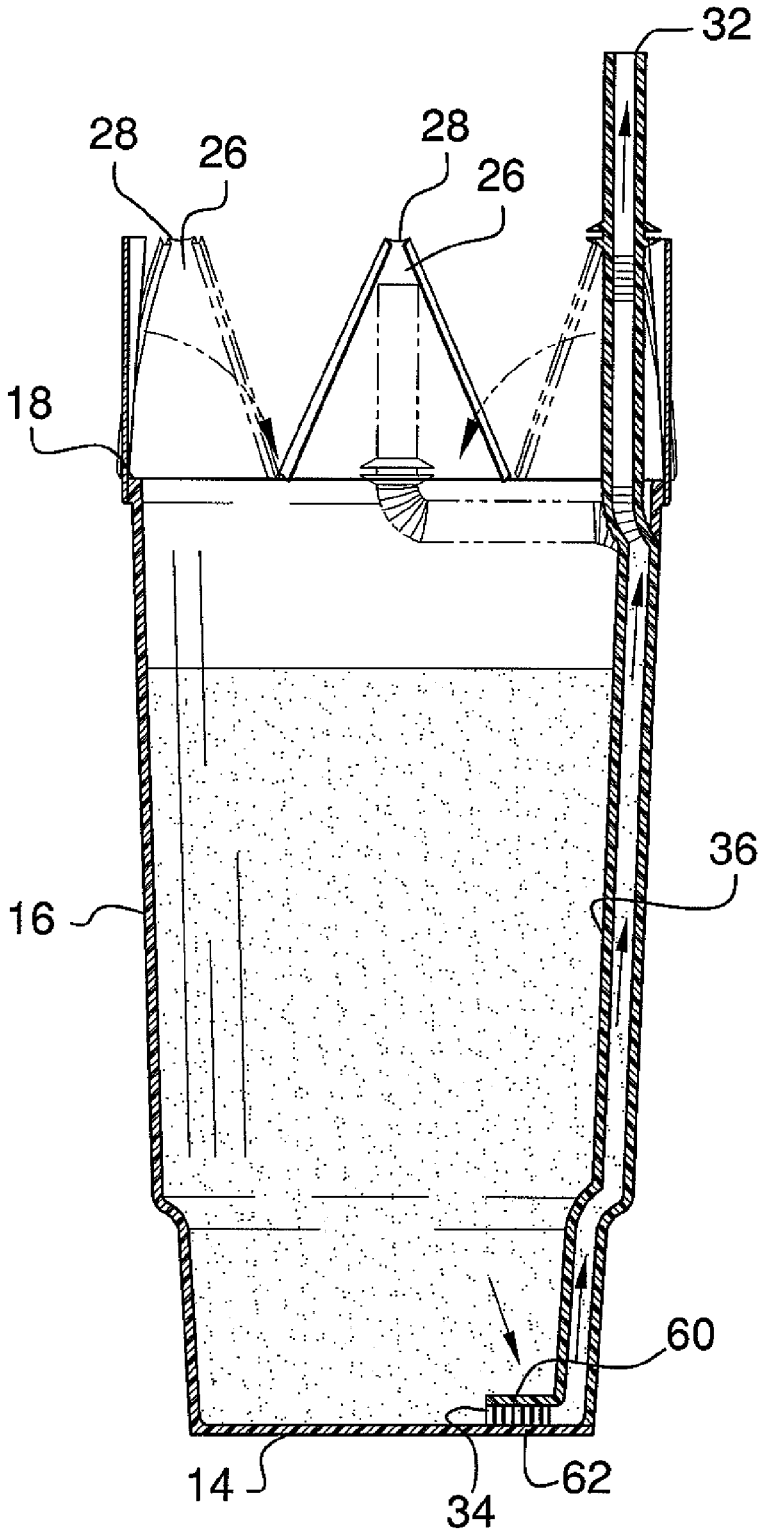
FIG. 4 is a cross-sectional view taken along line 4-4 of FIG. 1 of an embodiment of the disclosure.
Figure 5:
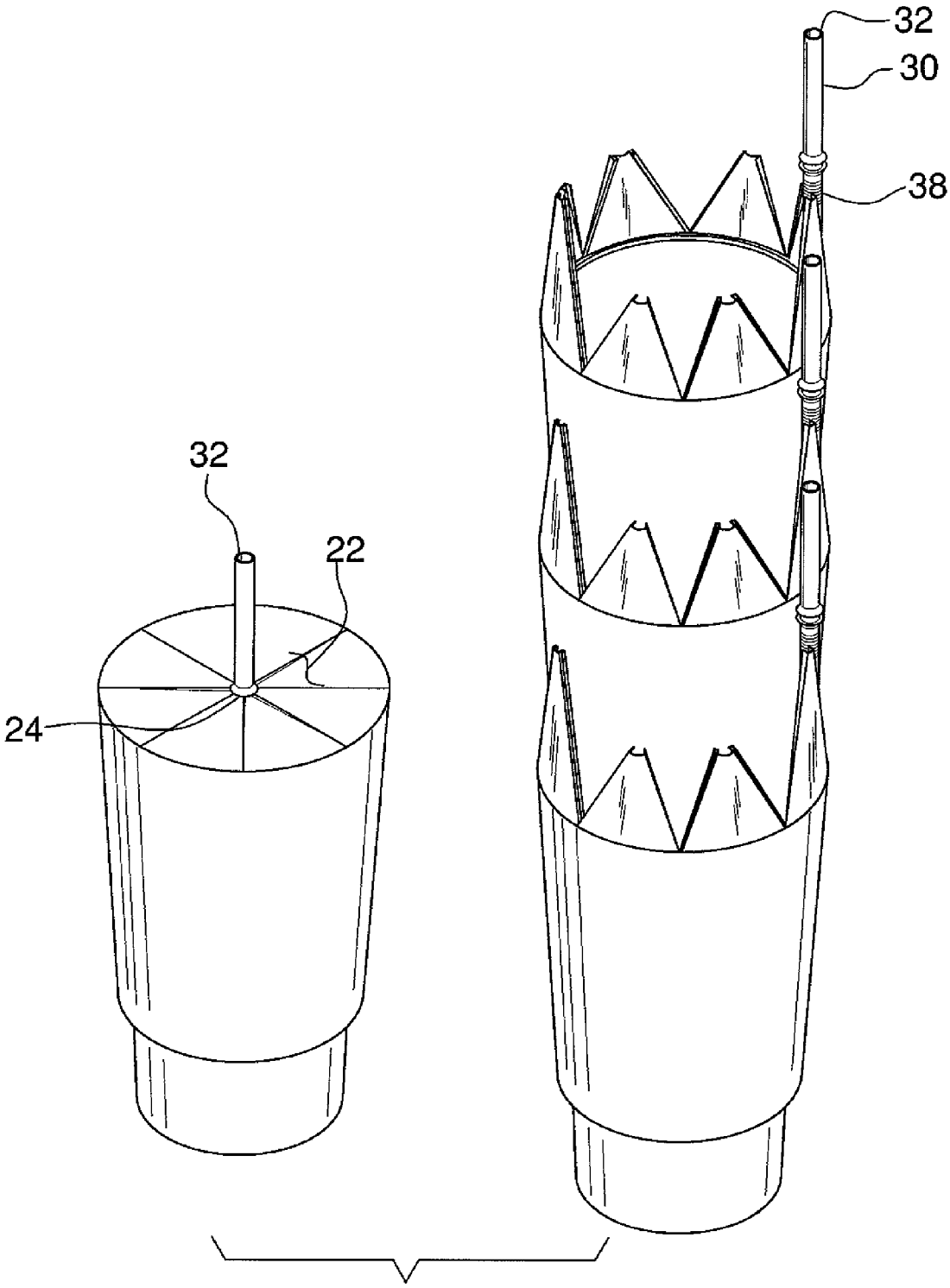
FIG. 5 is a side perspective view of an embodiment of the disclosure.
Figure 6:
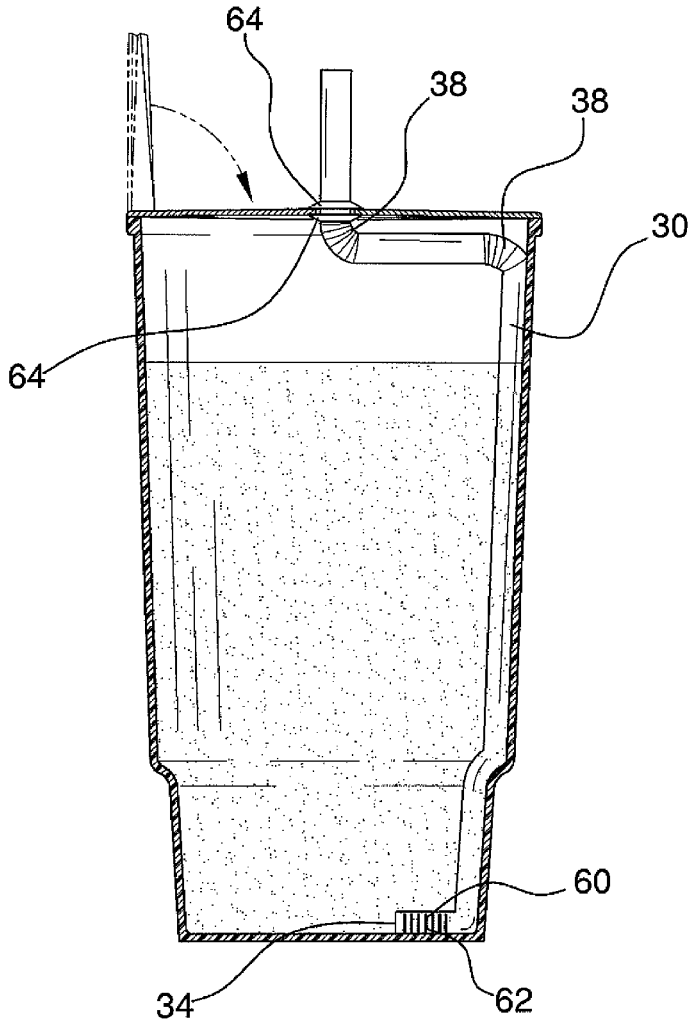
FIG. 6 is a cross-sectional view taken along line 6-6 of FIG. 3 of an embodiment of the disclosure.

With reference now to the drawings, and in particular to FIGS. 1 through 5 thereof, a new drinking container device embodying the principles and concepts of an embodiment of the disclosure and generally designated by the reference numeral 10 will be described.

As best illustrated in FIGS. 1 through 5, the drinking container assembly 10 generally comprises a housing 12 that has a bottom wall 14 and a perimeter wall 16 that is attached to and extends upwardly from the bottom wall 14. The perimeter wall 16 has an upper edge 18 defining an opening 20 extending into the housing 12.

Figure 7:
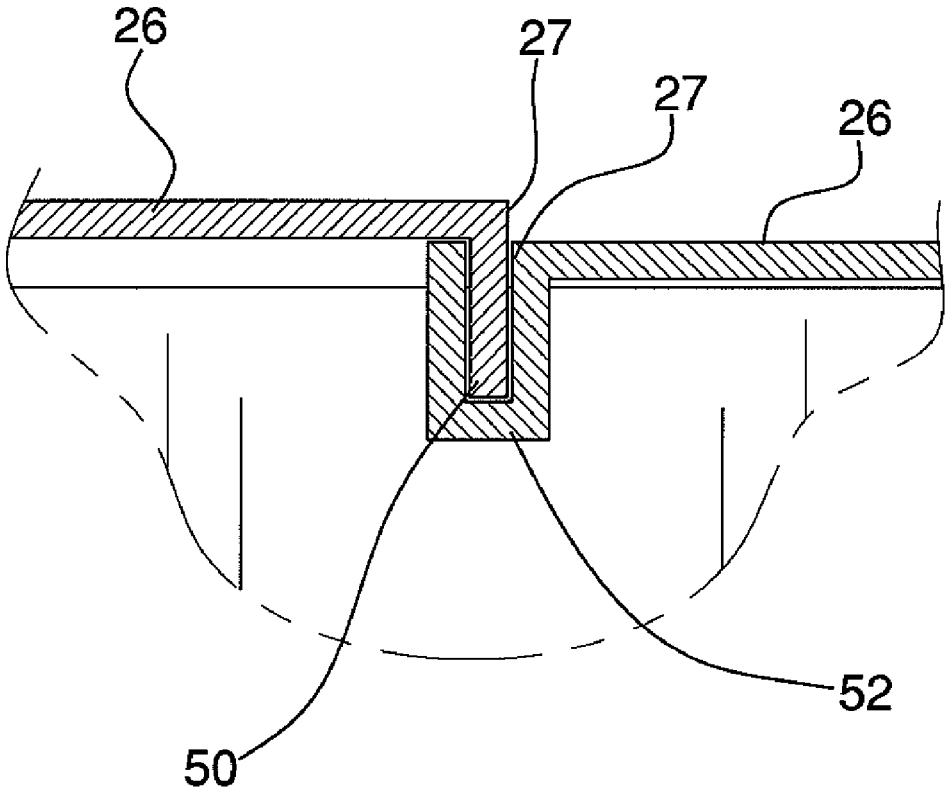
FIG. 7 is a cross-sectional view taken along line 7-7 of FIG. 1 of an embodiment of the disclosure.

A closure 22 is attached to and is coextensive with the upper edge 18. The closure 22 is positionable in an open position extending upwardly from the upper edge 18 or in a closed position folded downwardly over the opening 20. The closure 22 has an access aperture 24 extending their through and into the housing 12 when the closure 22 is in the closed position. The access aperture 24 has a greatest width less than ½ inch or in other words the access aperture 24 does not have a width greater than ½ inch in any direction traversing its surface. The closure 22 comprises a plurality of overlapping panels 26 each having a terminal edge 28 positioned distal to the upper edge 18 and which are concavely arcuate. The panels 26 may be coupled together by overlapping and locking together lateral edges 27 of the panels 26 as shown in FIG. 7 wherein the lateral edges 27 alternate in forming detents 50 and catches 52.

A straw 30 has a top end 32, a bottom end 34 and a peripheral wall 36 extending between the top 32 and bottom 34 ends. The top 32 and bottom 34 ends are each open. The bottom end 34 is positioned within the housing 12 and is adjacent to the bottom wall 14. The top end 32 extends upwardly through the opening 20 in the housing 12 and through the aperture when the closure 22 is in a closed position. The terminal ends 28 may frictionally engage the straw 30 to help retain the closure 22 in the closed position. The peripheral wall 36 is integrally coupled to and nonremovable from the perimeter wall 16. The straw 30 includes a pair of corrugated sections 38 to facilitate bending of the straw 30. The straw 30 further has a defined bottom portion 60 that includes the bottom end 34. The bottom portion 60 extends laterally away from the perimeter wall 16 and toward a central area of the bottom wall 14 so that the bottom end 34 is vertically orientated and an aperture defined by the bottom end 34 is directed across the bottom wall 14. The bottom portion 60 has a plurality of slits 62 therein to allow liquid to flow into the straw 30 through the slits 62. This prevents ice from impeding fluid flow through straw 30 and may allow for the bottom end 34 to be closed.

A pair of perimeter flanges 64 is attached to and extends around the straw 30. The flanges 64 are spaced from each other and a receiving slot 66 is defined between the flanges 64. Each of the terminal ends 28 of the panels 26 is removably positioned in the receiving slot 66 to further retain the panels 26 in a closed position.

In use, the assembly 10 is used in a conventional manner to suction a beverage out of the housing 12 with the straw 30. The perimeter wall 16 may taper inwardly from the upper edge 18 to the bottom wall 14 to allow for easy stacking of a plurality of housings 12 as found in FIG. 5.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A drinking container assembly comprising:

a housing having a bottom wall and a perimeter wall being attached to and extending upwardly from said bottom wall, said the perimeter wall having an upper edge defining an opening extending into said housing;

a closure being attached to and being coextensive with said upper edge, said closure being positionable in an open position extending upwardly from said upper edge or in a closed position folded downwardly over said opening, said closure having an access aperture extending their through and into said housing when said closure is in said closed position, said access aperture having a greatest width less than ½ inch, said closure comprising a plurality of overlapping panels each having a terminal edge positioned distal to said upper edge and being concavely arcuate, said closure having a plurality of overlapping panels, said overlapping panels having overlapping and locking lateral edges, said locking edges alternating between forming a tongue and a groove, each said groove receiving said tongue of an adjacently positioned one of said overlapping panels whereby said lateral edges lock;

a straw having a top end, a bottom end and a peripheral wall extending between said top and bottom ends, said top and bottom ends each being open, said bottom end being positioned within said housing and adjacent to said bottom wall, said top end extending upwardly through said opening in said housing, said peripheral wall being integrally coupled to and nonremovable from said perimeter wall, said straw including a pair of corrugated sections to facilitate bending of said straw, said straw including a bottom portion including said bottom end, said bottom portion extending laterally away from said perimeter wall and toward a central area of said bottom wall so that said bottom end is vertically orientated and an aperture defined by said bottom end is directed across said bottom wall, said bottom portion having a plurality of slits therein to allow liquid to flow into said straw through said slits; and a pair of perimeter flanges being attached to and extending around said straw, said flanges being spaced from each other and a receiving slot being defined between said flanges, each of said terminal ends of said panels being removably positioned in said receiving slot.

* * * * *